US008839811B2

(12) United States Patent
Kang

(10) Patent No.: US 8,839,811 B2
(45) Date of Patent: Sep. 23, 2014

(54) DRAIN SYSTEM OF WATER PUMP FOR VEHICLE

(75) Inventor: Bongseong Kang, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 150 days.

(21) Appl. No.: 13/551,323

(22) Filed: Jul. 17, 2012

(65) Prior Publication Data

US 2013/0118604 A1 May 16, 2013

(30) Foreign Application Priority Data

Nov. 16, 2011 (KR) ..... 10-2011-0119845

(51) Int. Cl.
*F04D 29/00* (2006.01)
*F16L 55/168* (2006.01)
*F04B 53/06* (2006.01)

(52) U.S. Cl.
CPC ..... *F04B 53/06* (2013.01)
USPC ..... 137/312; 415/168.2

(58) Field of Classification Search
USPC ..... 137/312; 415/168.1, 168.2
See application file for complete search history.

(56) References Cited

U.S. PATENT DOCUMENTS

| | | | | |
|---|---|---|---|---|
| 5,226,787 | A * | 7/1993 | Freeman | 415/168.2 |
| 5,490,762 | A * | 2/1996 | Feucht et al. | 415/168.1 |
| 5,660,521 | A * | 8/1997 | Serio | 415/111 |
| 6,561,756 | B2 * | 5/2003 | Ozawa et al. | 415/168.2 |
| 8,419,353 | B2 * | 4/2013 | Hotta et al. | 415/168.2 |

FOREIGN PATENT DOCUMENTS

| | | | |
|---|---|---|---|
| JP | 2007-016629 | A | 1/2007 |
| JP | 3952594 | B2 | 5/2007 |
| JP | 2008-121488 | A | 5/2008 |

* cited by examiner

*Primary Examiner* — Kevin Lee
(74) *Attorney, Agent, or Firm* — Morgan, Lewis & Bockius LLP

(57) ABSTRACT

A drain system of a water pump for a vehicle according to an exemplary embodiment of the present invention may include: a drain hole formed at a water pump housing, wherein coolant having leaked from the water pump passes the drain hole; a drain chamber formed in the water pump housing and providing a space communicated with the drain hole; a drain plug disposed in the drain chamber and collecting the coolant passing the drain hole; and a plug penetration hole penetrating the drain plug so as to communicate an inside of the drain plug to an outside of the water pump housing, wherein a part of the coolant collected in the drain plug may be vaporized and be exhausted to the outside of the water pump housing through the plug penetration hole.

6 Claims, 2 Drawing Sheets

DRAIN SYSTEM OF WATER PUMP FOR VEHICLE

CROSS-REFERENCE TO RELATED APPLICATION

The present application claims priority to Korean Patent Application No. 10-2011-0119845 filed in the Korean Intellectual Property Office on Nov. 16, 2011, the entire contents of which is incorporated herein for all purposes by this reference.

BACKGROUND OF THE INVENTION

1. Field of the Invention

The present invention relates to a drain system of a water pump for a vehicle. More particularly, the present invention relates to a drain system that discharges coolant to the outside in a gaseous state.

2. Description of Related Art

Generally, a cooling apparatus of a vehicle maintains temperature of an engine in operation to be constant. In addition, the cooling apparatus is a water-cooled type using coolant or an air-cooled type using exterior air.

The air-cooled type uses a method in which the engine directly contacts the air. The air-cooled type does not need a coolant supplied thereto, thus leakage and freezing of coolant do not occur, and the system is simple. However, uniform cooling of the engine according to an operation condition thereof is difficult and a large amount of noise occurs in the air-cooled type, so this type is not widely used.

The water-cooled type uses coolant for cooling the engine, and is separated into a gravity circulation type and a forced circulation type according to the circulating type of the coolant. The coolant is circulated by convection in the gravity circulation type, and thus the gravity circulation type is not appropriate for a high performance engine. Meanwhile, the forced circulation type is the typical circulation type currently used for vehicles, and the coolant is circulated by an operation of a water pump in the forced circulation type. In addition, the forced circulation type is most appropriate for high performance engines. That is, the water pump is provided for circulating the coolant in the engine using the water-cooled type.

In addition, the water pump is operated by always being in direct contact with the coolant. Meanwhile, a failure of a bearing may be generated or the lifetime of a belt may be reduced when the coolant leaks from the water pump. Therefore, a sealing member is mounted at a drive shaft of the water pump so as to prevent leakage of coolant. In addition, a drain hole is formed at the water pump housing for preventing coolant in a gaseous state and including particles from passing the sealing member and permeating to the bearing. In other words, the coolant in a gaseous state passing the sealing member is reduced to a liquid state and is exhausted to the outside through the drain hole.

However, aesthetic features may be deteriorated if the coolant is exhausted to the outside through the drain hole. In addition, when the exhausted coolant in a liquid state directly contacts a timing belt or water pump belt and driving parts of the belts, the lifetime of the belts may be reduced or a failure of the driving parts may be generated.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a drain system of a water pump for a vehicle having advantages of exhausting coolant in a gaseous state to the outside.

A drain system of a water pump for a vehicle may include a drain hole formed at a water pump housing, wherein coolant having leaked from the water pump passes the drain hole, a drain chamber formed in the water pump housing and providing a space fluid-communicated with the drain hole, a drain plug disposed in the drain chamber and recessed to collect the coolant passing the drain hole, and a plug penetration hole penetrating the drain plug so as to fluid-communicate the space of the drain chamber to an outside of the water pump housing, wherein a part of the coolant collected in the drain plug is vaporized and is exhausted to the outside of the water pump housing through the plug penetration hole.

One end of the drain chamber is communicated with the drain hole and the other end of the drain chamber is open.

The drain plug is formed with a cup shape having an opened end such that the coolant flows into or out from the drain plug, and is inserted into and coupled to the drain chamber through the other end of the drain chamber.

The plug penetration hole is formed with a pipe shape and one end of the plug penetration hole is elongated to the opened end of the drain plug, and the one end of the plug penetration hole is disposed apart from the one end of the drain chamber by a predetermined distance.

A filtering portion is formed at the one end of the plug penetration hole having a hollow pipe shape and is protruded along to an exterior circumference of the one end of the plug penetration hole.

The filtering portion is slanted downwardly from the exterior circumference of the plug penetration hole such that a distal end of the filtering portion is disposed apart from the exterior circumference of the plug penetration hole.

The drain plug is releasably assembled to the drain chamber.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
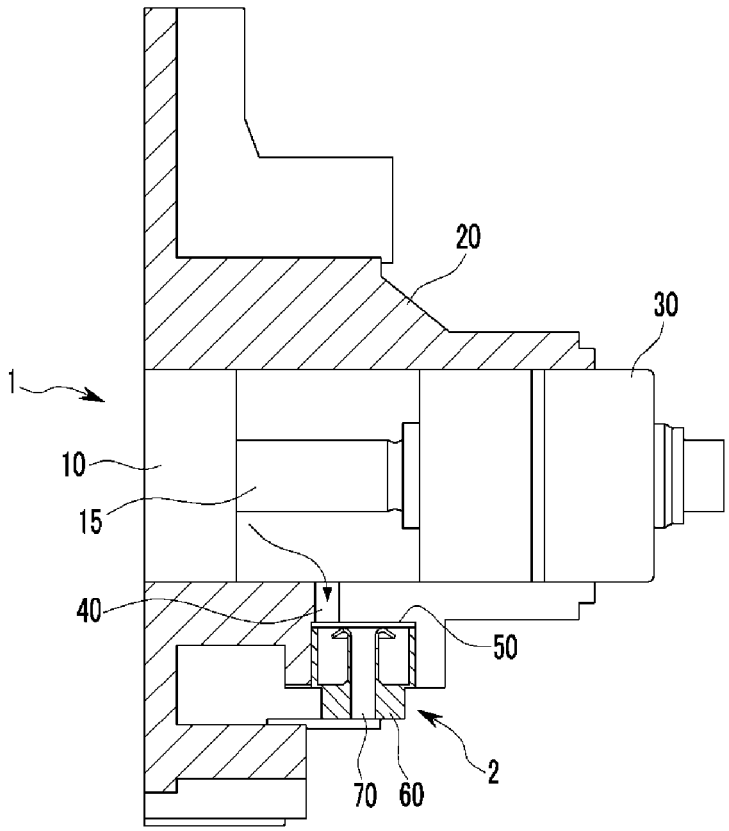
FIG. 1 is a schematic diagram of a water pump according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

FIG. 1 is a schematic diagram of a water pump according to an exemplary embodiment of the present invention.

As shown in FIG. 1, a water pump 1 according to an exemplary embodiment of the present invention includes a water pump housing 20, a water pump driving portion 10, a bearing 30 and a drain system 2.

The water pump driving portion 10 and the bearing 30 are mounted in the water pump housing 20.

The water pump driving portion 10 is operated by directly contacting and pumping the coolant.

The bearing 30 is connected with the water pump driving portion 10 by a water pump drive shaft 15. In addition, the bearing 30 is provided for smoothly rotating the water pump drive shaft 15 such that the water pump driving portion 10 easily pumps the coolant.

The construction of the water pump 1 is well-known to a person of ordinary skill in the art, so a detailed description thereof will be omitted.

The drain system 2 discharges coolant having leaked from the water pump driving portion 10 to the outside in a gaseous state. In addition, the drain system 2 is disposed at the water pump housing 20 and between the water pump driving portion 10 connected to the water pump drive shaft 15 and the bearing 30. Therefore, the drain system 2 prevents the coolant having leaked from the water pump driving portion 10 from permeating into the bearing. Meanwhile, arrows in FIG. 1 and FIG. 2 represent the flow of the coolant having leaked from the water pump driving portion 10.

Figure 2:
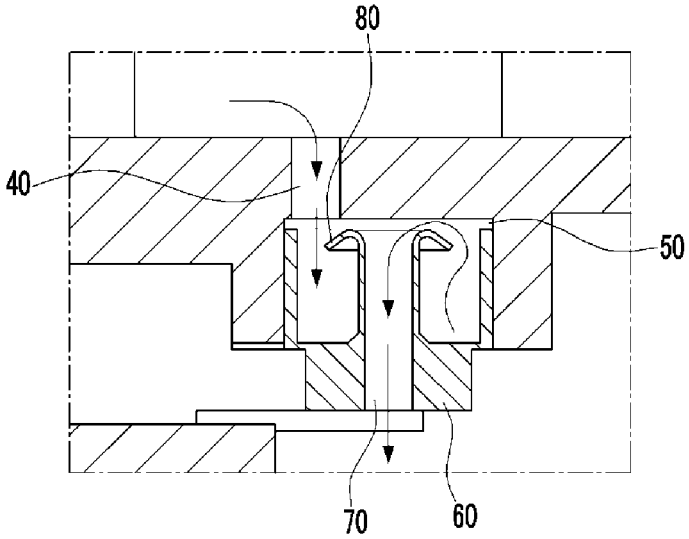
FIG. 2 is enlarged view of a drain system of a water pump for a vehicle according to an exemplary embodiment of the present invention.

FIG. 2 is enlarged view of a drain system of a water pump for a vehicle according to an exemplary embodiment of the present invention.

As shown in FIG. 2, the drain system 2 of a water pump for a vehicle according to an exemplary embodiment of the present invention includes a drain hole 40, a drain chamber 50, a drain plug 60, a plug penetration hole 70 and a filtering portion 80.

The drain hole 40 is disposed between the water pump driving portion 10 and the bearing 30 and is formed in the water pump housing 20. The coolant having leaked from the water pump driving portion 10 flows into the drain hole 40.

The drain chamber 50 is a space to communicate with the drain hole 40. In other words, one end of the drain chamber 50 is communicated with the drain hole 40, and the coolant passing through the drain hole 40 flows into the drain chamber 50. The other end of the drain chamber 50 is open.

The drain plug 60 is disposed in the drain chamber 50. In addition, the coolant flowed into the drain chamber 50 is collected in the drain plug 60. In other words, one end of the drain plug 60 is open toward the one end of the drain chamber 50 communicated with the drain hole 40. Further, the drain plug 60 is inserted into the drain chamber through the opened end of the drain chamber. The drain plug 60 can be assembled or disassembled with the water pump housing 20. In other words, the drain plug 60 may be inserted into or separated from the drain chamber 50.

The plug penetration hole 70 communicates the inside of the drain plug 60 and the outside of the water pump housing 20. In addition, one end of the plug penetration hole 70 penetrating the closed end of the drain plug 60 is elongated to the opened end of the drain plug 60, and the plug penetration hole 70 is formed with a hollow pipe shape. Further, the plug penetration hole 70 can be integrally formed with the drain plug 60.

Meanwhile, the coolant collected in the drain plug 60 is stored in a liquid state. In addition, the coolant in a liquid state is naturally vaporized. The vaporized coolant is exhausted to the outside of the water pump housing 20 through the plug penetration hole 70. Therefore, the one end of the plug penetration hole 70 is disposed apart from the one end of the drain chamber 50 by a predetermined distance such that the coolant vaporized in the drain plug 60 flows into the plug penetration hole 70.

The filtering portion 80 is formed at the one end of the plug penetration hole 70. In addition, the filtering portion 80 protrudes along to an exterior circumference of the one end of the plug penetration hole 70. The filtering portion 80 is slanted downwardly from the exterior circumference of the plug penetration hole 70 such that an end of the filtering portion 80 is disposed apart from the exterior circumference of the plug penetration hole 70. Therefore, a part of the vaporized coolant is filtered by the filtering portion 80 and is liquefied, and the other part of the coolant that is relatively more vaporized flows into the plug penetration hole 70.

According to an exemplary embodiment of the present invention, aesthetic features are improved since the coolant is exhausted to the outside in a gaseous state. In addition, the coolant in a liquid state is prevented from directly contacting the timing belt or the water pump belt and the driving parts of the belts. Therefore, durability of the timing and water pump belts and the driving parts of the belts can be improved.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A drain system of a water pump for a vehicle comprising:

a drain hole formed at a water pump housing, wherein coolant having leaked from the water pump passes the drain hole;

a drain chamber formed in the water pump housing and providing a space fluid-communicated with the drain hole;

a drain plug disposed in the drain chamber and recessed to collect the coolant passing the drain hole; and a plug penetration hole penetrating the drain plug so as to fluid-communicate the space of the drain chamber to an outside of the water pump housing;

wherein a part of the coolant collected in the drain plug is vaporized and is exhausted to the outside of the water pump housing through the plug penetration hole; and wherein one end of the drain chamber is communicated with the drain hole and the other end of the drain chamber is open.

2. The system of claim 1, wherein the drain plug is formed with a cup shape having an opened end such that the coolant flows into or out from the drain plug, and is inserted into and coupled to the drain chamber through the other end of the drain chamber.

3. The system of claim 2, wherein the plug penetration hole is formed with a pipe shape and one end of the plug penetration hole is elongated to the opened end of the drain plug, and the one end of the plug penetration hole is disposed apart from the one end of the drain chamber by a predetermined distance.

4. The system of claim 3, wherein a filtering portion is formed at the one end of the plug penetration hole having a hollow pipe shape and is protruded along to an exterior circumference of the one end of the plug penetration hole.

5. The system of claim 4, wherein the filtering portion is slanted downwardly from the exterior circumference of the plug penetration hole such that a distal end of the filtering portion is disposed apart from the exterior circumference of the plug penetration hole.

6. The system of claim 1, wherein the drain plug is releasably assembled to the drain chamber.

* * * * *